United States Patent [19]

Bergman

[11] Patent Number: 4,966,259

[45] Date of Patent: Oct. 30, 1990

[54] LUGGAGE CONTAINER WITH PULL HANDLE

[76] Inventor: Mady I. Bergman, 216 Pacific Ave., Venice, Calif. 90291

[21] Appl. No.: 152,147

[22] Filed: Feb. 4, 1988

[51] Int. Cl.[5] ..... A45C 13/30

[52] U.S. Cl. ..... 190/18 A; 190/115; 190/117; 16/112; 16/124

[58] Field of Search ..... 16/112, 124, 125, 126, 16/DIG. 24; 190/18 A, 39, 115, 116, 117

[56] References Cited

U.S. PATENT DOCUMENTS

| | | | |
|---|---|---|---|
| 2,042,387 | 5/1936 | Cobb | 190/18 A |
| 3,184,101 | 5/1965 | Pentesco | 16/125 X |
| 3,708,045 | 1/1973 | Katz | 190/115 |
| 3,944,033 | 3/1976 | Simson | 190/117 |
| 4,262,780 | 4/1981 | Samuelian | 190/18 A |
| 4,545,414 | 10/1985 | Baum | 190/115 X |
| 4,813,520 | 3/1989 | Lin | 190/18 A |
| 4,838,396 | 6/1989 | Krenzel | 190/18 A |

FOREIGN PATENT DOCUMENTS

| | | | |
|---|---|---|---|
| 2538229 | 6/1984 | France | 190/18 A |
| 69148 | 4/1945 | Norway | 16/126 |

*Primary Examiner*—Richard K. Seidel
*Assistant Examiner*—James Miner
*Attorney, Agent, or Firm*—Epstein, Edell & Retzer

[57] ABSTRACT

An aircraft carry-on bag fitted with transport casters or slides on a rigid bottom and pulled by a strap or rigid handle bridle fastened on both vertical sides of said bag near its top front edge.

11 Claims, 7 Drawing Sheets

LUGGAGE CONTAINER WITH PULL HANDLE

BACKGROUND OF THE INVENTION

Airlines provide space beneath seats for storing carry-on articles. Usual dimension limitation for such articles is that the sum of the length plus width plus height should not exceed 45 inches.

A loaded bag falling within this dimension criterion can weigh over 40 pounds and become difficult to carry. These bags are therefore sometimes fitted with friction slides, small wheels or ball casters on their bottoms and pulled by means of a single strap or handle fastened to a clip or ring located in the middle of the leading or front section of the bag. To facilitate steering or directing the bag, front caster wheels are swivel-mounted while the rear wheels are rigidly mounted for stability. With friction slides, swivel-mounted front caster wheels and ball casters, the bags have a tendency to swerve back and forth as they are pulled by means of a single strap or handle. Such swerving usually causes the bag to overturn.

SUMMARY OF INVENTION

In the present invention the normally used single pull strap or handle fastened to the center of the front and leading side of the bag is replaced with two straps, each of which is bridle-fastened adjacent to the top edge of the sides of the bag; or by a rigid handle fastened by swivel pins on both sides of the bag near the top front edges. The leading ends of the two straps are joined by means of a buckle or some other device, or a bridle-attached single strap is used.

DRAWINGS

These and other features, aspects, and advantages will become better understood with reference to the following description, appended claims and accompanying drawings, where:

DETAILED DESCRIPTION OF THE PREFERRED EMBODIMENTS

Figure 1:
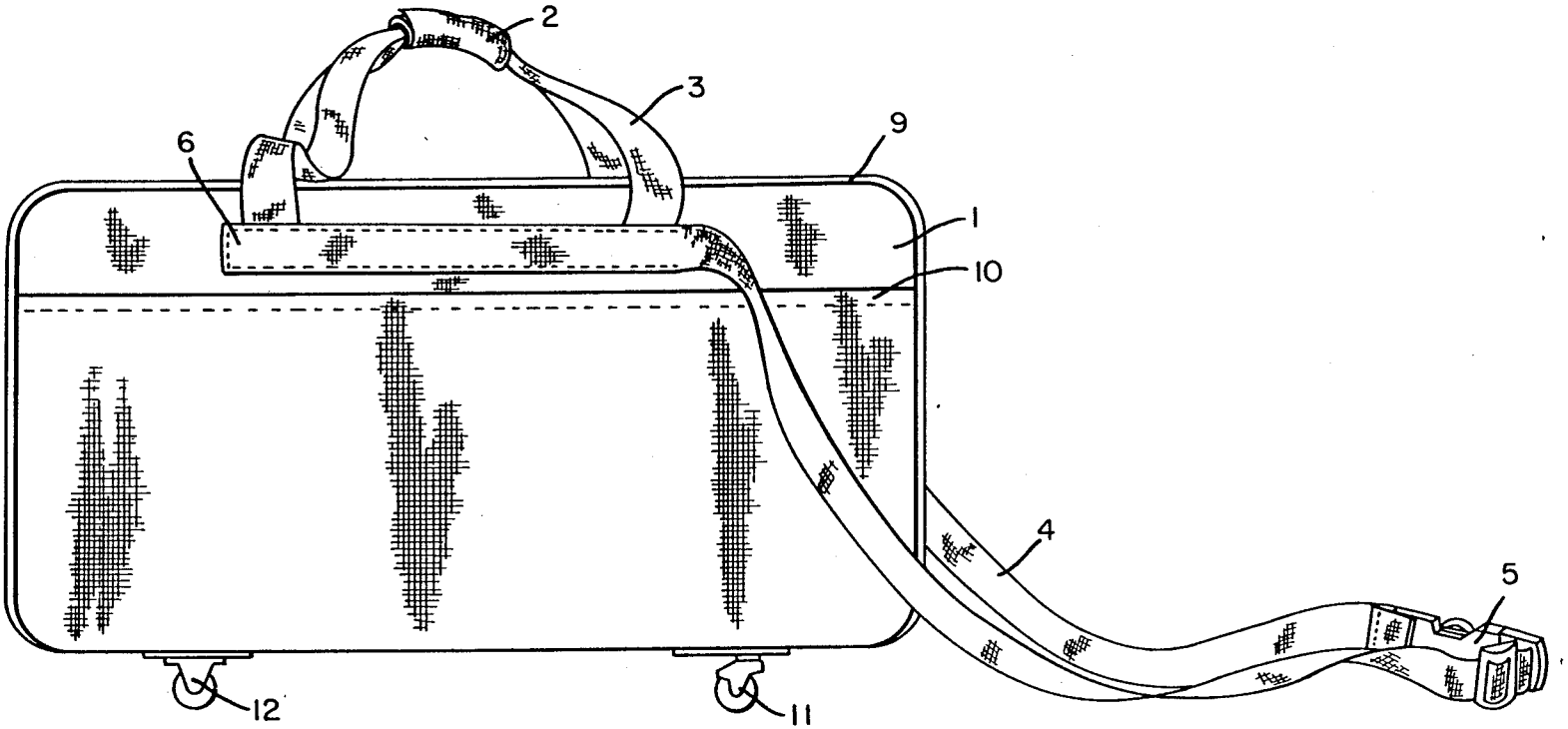
FIG. 1 is a side elevational view of a luggage container with a pull strap having features of the invention.

The invention will now be described in greater detail by means of reference to the drawings in which:

FIG. 1 shows a side view of the bag where Item 1 signifies the fabric of construction, which preferably should be 1000 denier waterproof Kordura or equivalent; Item 2 represents a flap for holding the carrying handles together, said flap to be fastened by means of Velcro or clips; Item 3 represents the handles; Item 4 represents the pull straps; Item 5 represents an adjustable strap buckle; Item 6 represents the preferred length of fastening the strap to the bag for improved stability when pulled; Item 9 represents a flap which covers the closing zippers and protects them from rain or snow; Item 10 represents a side pocket with zipper; Item 11 represents the front swivel-mounted transport wheels; Item 12 represents the rear mounted transport wheels which are not swivel-mounted.

Figure 2:
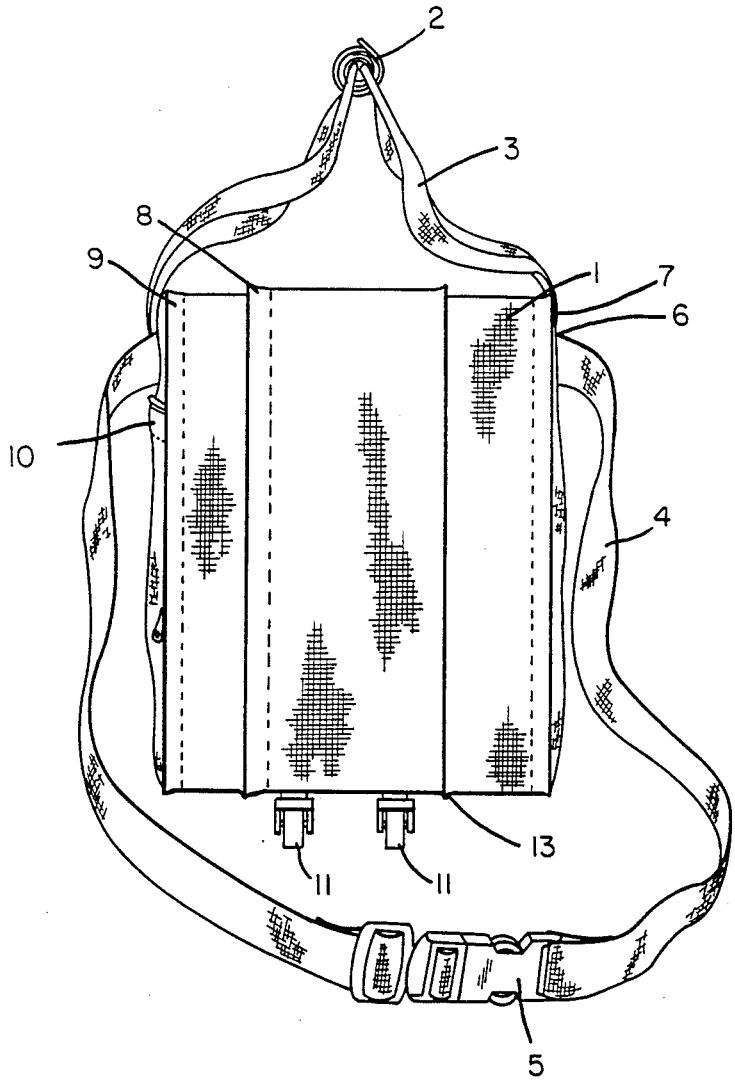
FIG. 2 is a front view of the luggage container of FIG. 1.

Additional detail is provided in FIG. 2 where Item 7 illustrates the left zipper flap; Item 8 represents the center zipper flap; Item 10 represents a pocket with zipper; and Item 13 represents piping in the seams of the bag.

Figure 3:
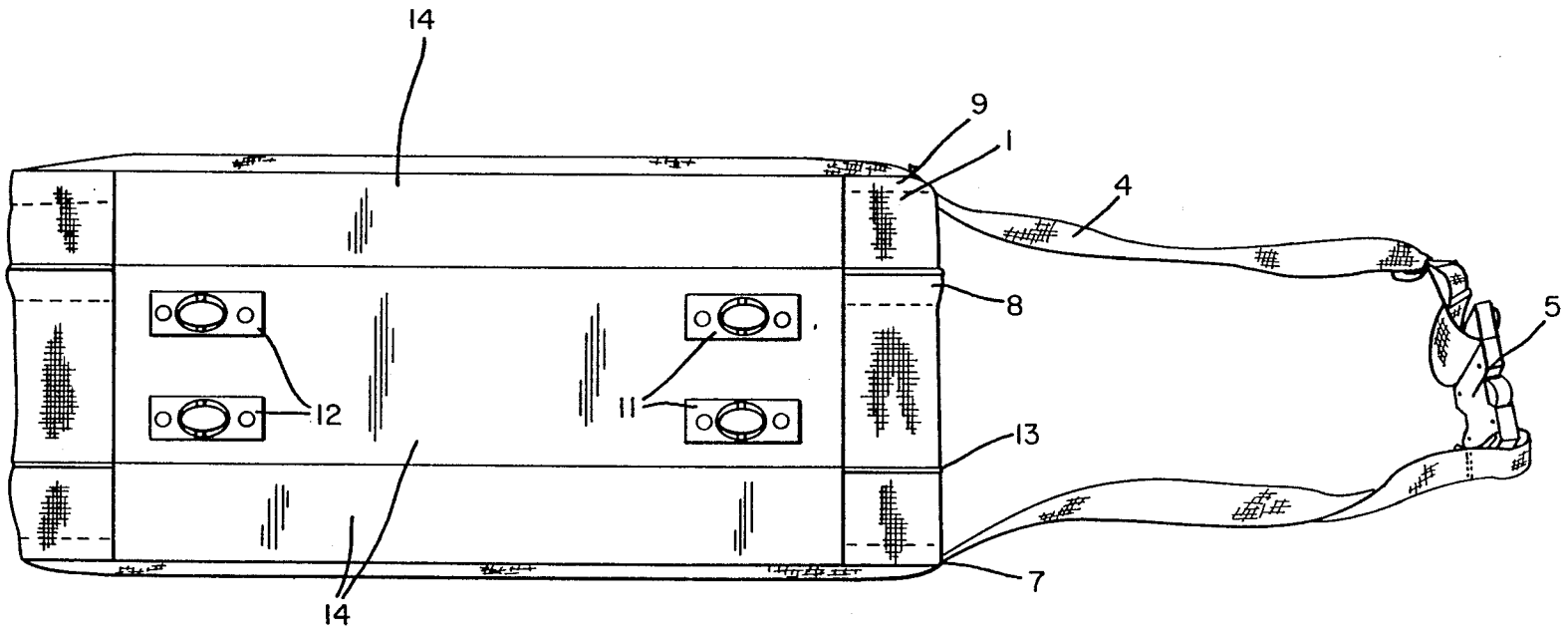
FIG. 3 is a bottom view of the luggage container of FIG. 1.

Additional detail is provided in FIG. 3 where Item 14 represents the rigid bottom of the bag required for the slides, transport wheel, or ball caster mountings, and which is constructed in a pleated manner so that the bottom is semi-collapsible and facilitates the squeezing of the bag into the allotted space.

Figure 4:
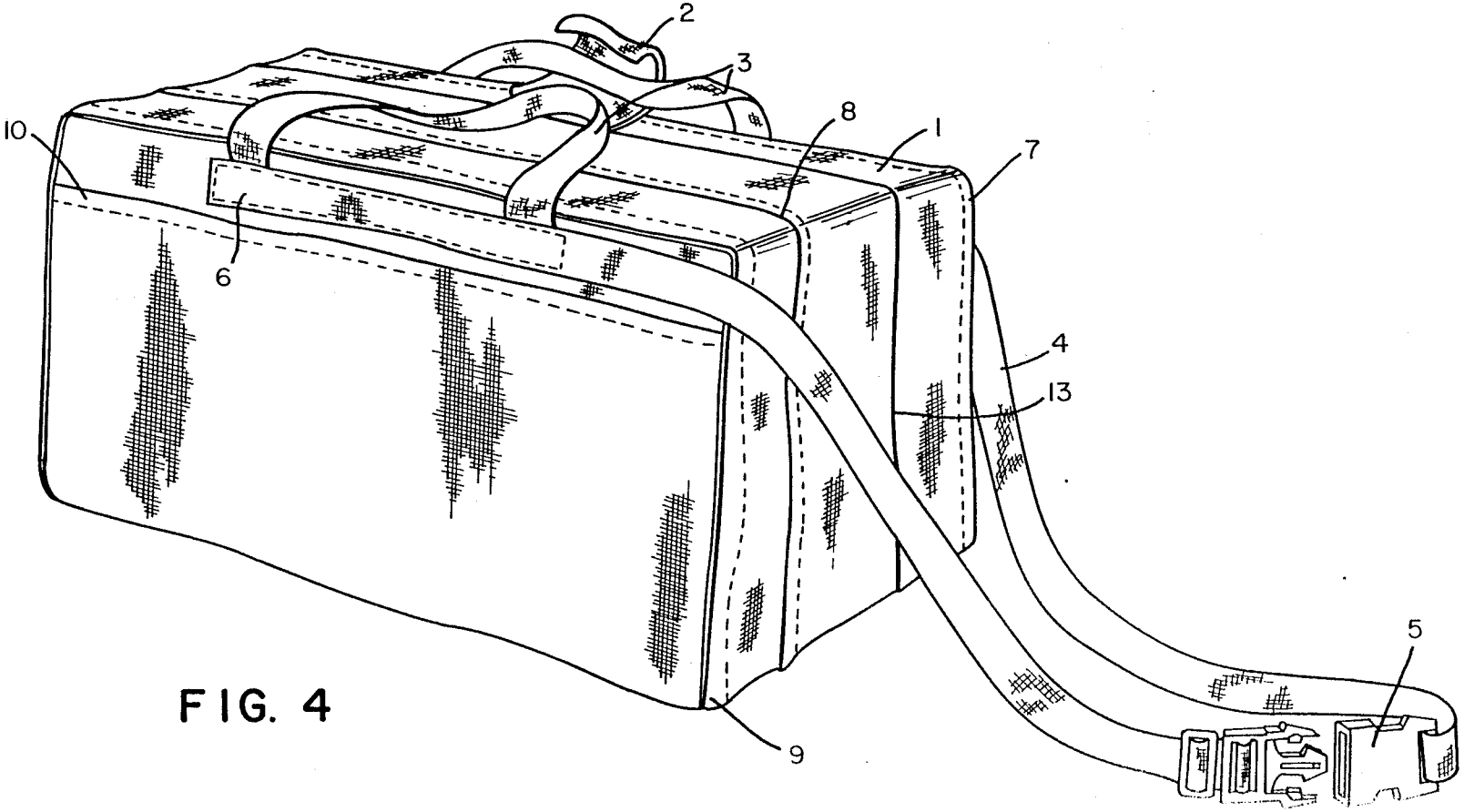
FIG. 4 is a perspective view of the luggage container of FIG. 1 showing the buckle unlatched.

FIG. 4 is provided to facilitate visual understanding of the bag construction.

Although the pull straps can be fastened to the sides of the bag by conventional means such as rivets, adhesive, buckles, clips or by stitching for a short length, it has been found that greater stability and less tendency to wobble during movement of the bag is obtained if the straps are fastened to the bag along a major portion of the available length of the bag at its upper edge. This length should comprise at least fifty percent of the bag length and the fastening should start within a few inches of the front panel of the bag.

Figure 5:
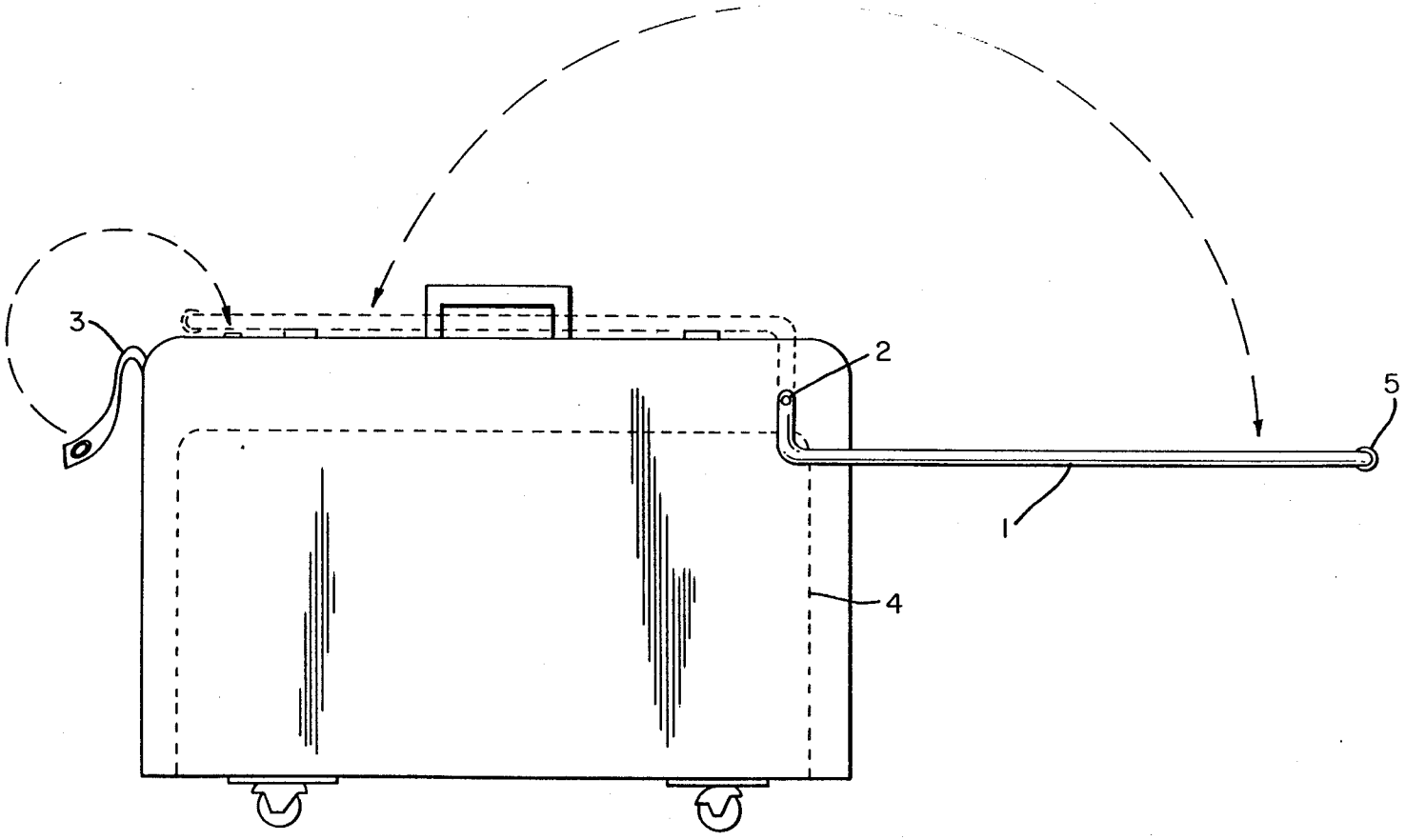
FIG. 5 is a side view of another luggage container having features of the present invention.
Figure 7:
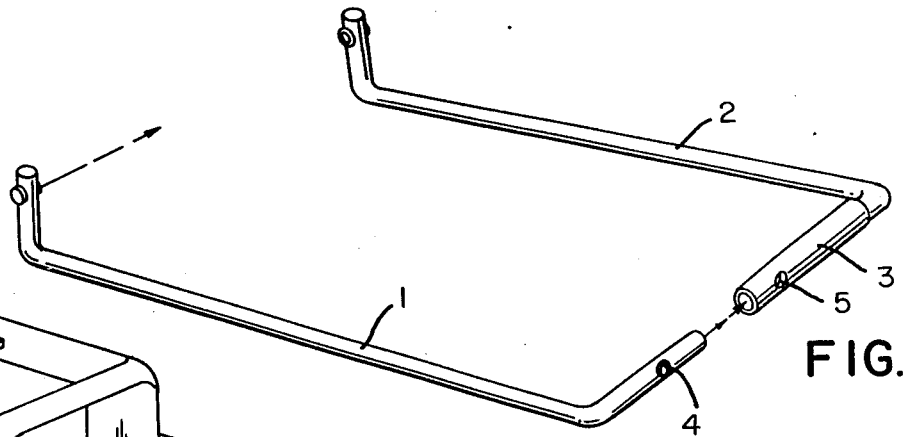
FIG. 7 is an exploded view of the handle of the container in FIG. 6.

FIG. 5 illustrates the situation where the flexible pull strap is replaced by a rigid handle. Item 15 represents the rigid handle fabricated from plastic, wood, metal rod or tube. This handle is shaped in dog-leg fashion as shown so that it can be pivoted into a snug position over the top of the bag (as shown by the phantom lines 15*a*). Item 16 is a pin or rivet fastened to the bag which serves as a swivel for Handle 15. Item 17 is a buckle or clip which is used to secure the handle to the top of the bag in the fold-back position. Item 18 illustrates a zippered side panel for opening the bag from its sides. In the case of this type of bag construction, the rigid handle can be fashioned in a single piece and Item 19 represents a convenience grip.

Figure 6:
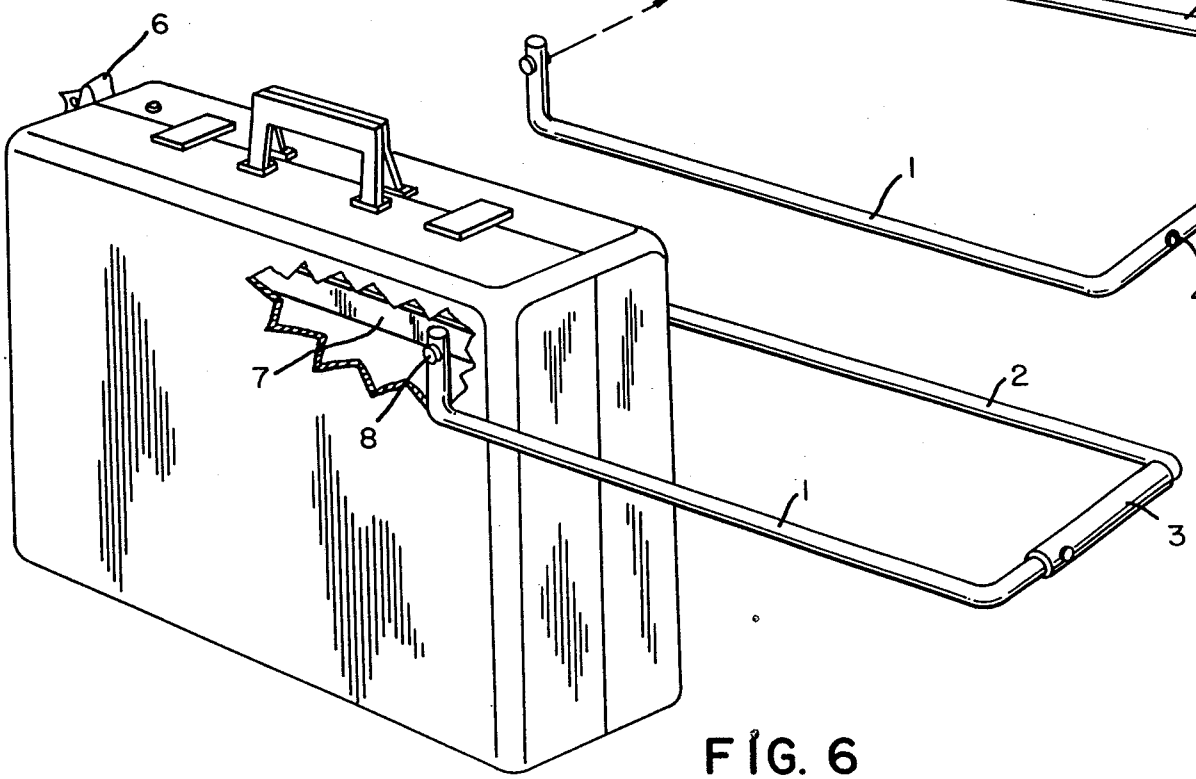
FIG. 6 is a perspective view of yet another luggage container having features of the invention.

FIG. 6 illustrates the situation where the suitcase is opened in a clam shell fashion. In this case the rigid handle is fashioned in two pieces as illustrated by Items 20 and 21. These same items are clipped together by means of Item 22 which is a coupling similar to the type used on vacuum cleaner tubes. This coupling allows Item #1 to slip and join Item 21 at their ends. They are locked in place by means of a spring loaded ball illustrated as Item 23. When the handle is in its fold-back position it can be held in place with the clip strap illustrated by Item 17. If the suitcase is to be opened Item 23 is pressed to release the Item 22 clip and allow the handle to separate.

Item 24 illustrates a rigid bar fastened near the top of the side panel and to which the Item 16 swivel pin is connected. This rigid bar is the preferred method for fastening the pivot to the bag as it imparts a degree of stability in maneuvering the bag with the rigid handle.

Figure 8:
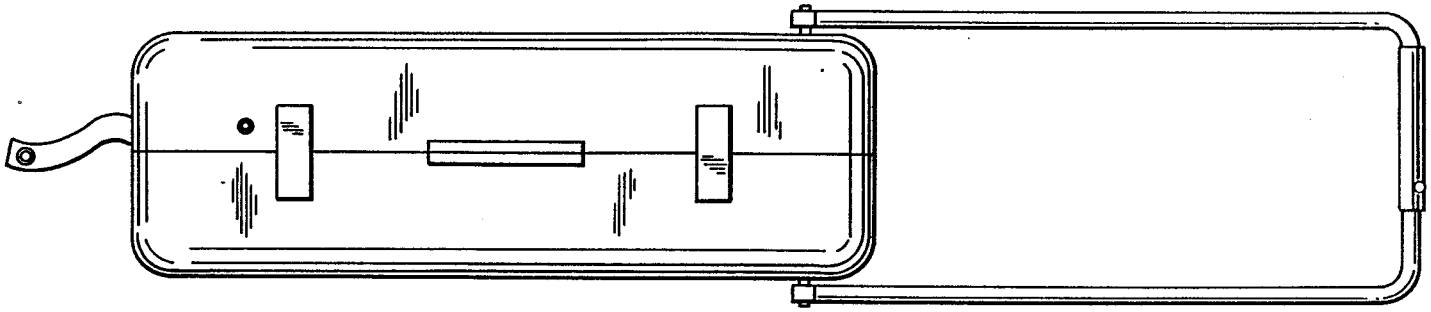
FIG. 8 is a top view of the luggage container of FIG. 6.
Figure 9:
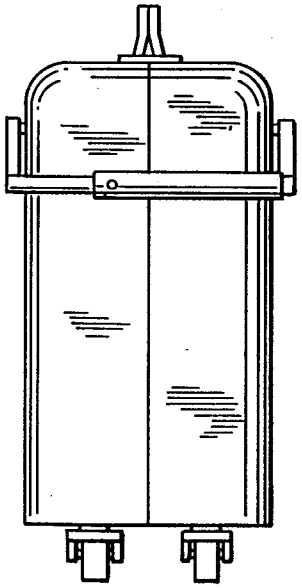
FIG. 9 is a front view of the luggage container of FIG. 6.

FIGS. 8 and 9 are provided to further illustrate the bag construction and the rigid pull handle.

Although the present invention has been described in considerable detail with reference to certain preferred versions thereof, other versions are possible. For example, although a single type of coupling device has been illustrated, other types such as a spring loaded slide coupling, a bayonet clip type, a telescoping type, or a screw type can be used.

Although reference is made throughout this disclosure to airline carry-on bags, it is not the intent of this invention to limit its application to this capacity. This invention can be applied to all types and sizes of caster or slide-transported luggage for use on trains, buses, ships and all other vehicles of transportation. Therefore, the spirit and scope of the appended claims should not necessarily be limited to the description of the preferred versions contained herein.

I claim:

1. A luggage container comprising:

(a) a container body having first and second opposing vertical sides and a bottom member, the first vertical side having a first forward edge, a first rear edge, a first top edge, a first bottom edge, and a first horizontal length between the first forward and rear edges, and the second vertical side having a second forward edge, a second rear edge, a second top edge, a second bottom edge, and a second horizontal length between the second forward and rear edges, the bottom member being attached to the vertical sides between the first and second bottom edges, respectively, the body forming an enclosed cavity between the first and second vertical sides and above the bottom member, the body having means for opening and closing the container, the first and second horizontal lengths being about the same;

(b) wheel means for moving the container body horizontally along a ground surface, the wheel means being attached to and extending outwardly from the bottom member of the container body;

(c) a flexible strap for pulling the container along the ground surface having first and second attaching ends, the first attaching end being attached at a first forward point of attachment on the first vertical side and at a first rearward point of attachment on the first vertical side; the second attaching end being attached at a second forward point of attachment on the second vertical side and at a second rearward point of attachment on the second vertical side; the first and second forward points of attachment being about the same horizontal distance from the first and second forward edges and about the same vertical distance from the first and second bottom edges, respectively, the horizontal distance between said first forward and rearward points of attachment being a major portion of said first horizontal length, and the horizontal distance between said second forward and rearward points of attachment being a major portion of said second horizontal length.

2. The luggage container of claim 1 wherein the wheel means comprises a set of four wheels.

3. The luggage container of claim 2 wherein the wheel means comprises two swivel wheels attached proximate a front edge of the bottom member and two non-swivel wheels attached proximate a back edge of the bottom member.

4. The luggage container of claim 1 wherein the flexible strap comprises first and second strap portions having first and second free ends, the strap further having latching means for alternatively latching and unlatching the free ends.

5. The luggage container of claim 4 wherein the latching means comprises a buckle.

6. The luggage container of claim 1 wherein the flexible strap is attached continuously to the vertical sides from said first forward point of attachment to said first rearward point of attachment and from said second forward point of attachment to said second rearward point of attachment.

7. The luggage container of claim 1 wherein said first and second rearward points of attachment are about the same vertical distance from the first and second bottom edges, respectively.

8. A luggage container comprising:

(a) a container body having first and second container shells, the first and second shells having first and second vertical sides and first and second lower and upper ledges, respectively, the container shells being hinged along free edges of their respective lower ledges thereby forming means for alternatively opening and closing the container and further forming a bottom member of the container;

(b) wheel means for moving the container along the ground surface, the wheel means being attached to and extending outwardly from the bottom member;

(c) a first rigid handle bar having a first attaching end, a first dog-legged segment, a first extension arm, and a first handle portion; the first attaching end being hinged to the first vertical side at a first pivot point near the first forward ledge, the first extension arm being attached to and extending from the first dog-legged segment opposite the first attaching end, the first dog-legged segment having a first component of length perpendicular to the extension arm, the first component of length being slightly greater in length than the distance between the first pivot point and the first upper edge, the first extension arm being attached to the first handle portion opposite the first dog-legged segment;

(d) a second rigid handle bar having a second attaching end, a second dog-legged segment, a second extension arm, and a second handle portion; the second attaching end being hinged to the second vertical side at a second pivot point near the second forward ledge, the second extension arm being attached to and extending from the second dog-legged segment opposite the second attaching end, the second dog-legged segment having a second component of length perpendicular to the extension arm, the second component of length being slightly greater in length than the distance between the second pivot point and the second upper edge, the second extension arm being attached to the second handle portion opposite the second dog-legged segment;

(e) coupling means for separably coupling the first and second handle portions at their free ends so that the handle portions are selectively separable and couplable when the container is opened and closed, respectively, the handle bars forming a hinged handle when the handle portions are attached, the hinged handle having a first position wherein the container can be pulled along the ground surface and a second position wherein the first and second extension arms rest snugly along the first and second upper edges, respectively.

9. The luggage container of claim 8 further comprising a retaining means for retaining the hinged handle member in its second position, the retaining means being proximate the upper ledges at an end of the container opposite the pivot points.

10. The luggage container of claim 9 wherein the retaining means is a clip strap.

11. The luggage container of claim 8 wherein the handle members are hinged to the container shells by swivel pins extending through the vertical sides at the pivot points, the pins being affixed to rigid bars attached to the opposing vertical sides inside the luggage container.

* * * * *